US012584497B2

(12) United States Patent
Hasumi

(10) Patent No.: US 12,584,497 B2
(45) Date of Patent: Mar. 24, 2026

(54) FAN DRIP-PROOF STRUCTURE

(71) Applicant: TOSHIBA MITSUBISHI-ELECTRIC INDUSTRIAL SYSTEMS CORPORATION, Chuo-ku (JP)

(72) Inventor: Satoshi Hasumi, Tokyo (JP)

(73) Assignee: TMEIC Corporation, Chuo-ku (JP)

( * ) Notice: Subject to any disclaimer, the term of this patent is extended or adjusted under 35 U.S.C. 154(b) by 0 days.

(21) Appl. No.: 18/245,035

(22) PCT Filed: Aug. 19, 2021

(86) PCT No.: PCT/JP2021/030367

§ 371 (c)(1),
(2) Date: Mar. 13, 2023

(87) PCT Pub. No.: WO2023/021655

PCT Pub. Date: Feb. 23, 2023

(65) Prior Publication Data

US 2023/0366412 A1 Nov. 16, 2023

(51) Int. Cl.
*F04D 29/46* (2006.01)
*F04D 17/08* (2006.01)

(52) U.S. Cl.
CPC ..... *F04D 29/462* (2013.01); *F04D 17/08* (2013.01)

(58) Field of Classification Search
CPC ..... F04D 17/08; F04D 29/462
See application file for complete search history.

(56) References Cited

U.S. PATENT DOCUMENTS

2006/0116065 A1* 6/2006 Ishii ..... H05K 7/20181 454/184
2020/0187382 A1* 6/2020 Linares ..... H05K 7/20572

FOREIGN PATENT DOCUMENTS

| | | | | |
|---|---|---|---|---|
| CN | 208205310 | U | | 12/2018 |
| CN | 208363391 | U | | 1/2019 |
| CN | 213392772 | U | | 6/2021 |
| CN | 214035978 | U | * | 8/2021 |
| JP | H11115806 | A | * | 4/1999 |
| JP | 2001263721 | A | * | 9/2001 |
| JP | 2003207171 | A | * | 7/2003 |
| JP | 2008-103637 | A | | 5/2008 |
| JP | 2011-12613 | A | | 1/2011 |
| JP | 2011012613 | A | * | 1/2011 |
| JP | 2020-44949 | A | | 3/2020 |

(Continued)

OTHER PUBLICATIONS

JP-H11115806-A (Nakai et al.; Apr. 1999) English Translation (Year: 2023).*

(Continued)

*Primary Examiner* — Nathaniel E Wiehe
*Assistant Examiner* — Aye S Htay
(74) *Attorney, Agent, or Firm* — Oblon, McClelland, Maier & Neustadt, L.L.P.

(57) ABSTRACT

A fan drip-proof structure of an embodiment includes a housing, one or more open-close members, and a regulation member. The housing accommodates a fan. The one or more open-close members open and close a vent port formed on the housing in response to a wind force of an air flow of the fan. The regulation member regulates an open degree of the vent port by the open-close member.

5 Claims, 4 Drawing Sheets

(56) References Cited

FOREIGN PATENT DOCUMENTS

| | | | |
|---|---|---|---|
| JP | 2020-150671 | A | 9/2020 |
| KR | 2000-0017026 | U | 9/2000 |

OTHER PUBLICATIONS

JP-2003207171-A (Yoshida; Jul. 2003) English Translation (Year: 2023).*
JP-2011012613-A (Tosaka; Jan. 2011) English Translation (Year: 2023).*
CN-214035978-U (Aug. 2021; Yu et al.) English Translation (Year: 2023).*
JP-2001263721 (Sep. 2001; Komagata et al.) English Translation (Year: 2023).*
JP-2003207171 (Jul. 2003; Yoshida) English Translation (Year: 2023).*
International Search Report issued Oct. 12, 2021 in PCT/JP2021/030367, filed on Aug. 19, 2021, 4 pages (with English Translation).
Office Action dated Apr. 16, 2025, issued in counterpart CN Application No. 202180066285.7, with machine translation. (15 pages).
"Urban Integrated Utility Tunnel Project", Yao Haibo et al., pp. 310-311, China Building Materials Industry Publishing House. Published in Jun. 2020, with a release date of Jun. 30, 2020. (relevant English part is mentioned in English Translation of Chinese Office Action dated Oct. 28, 2025)(4 pages).
Office Action dated Oct. 28, 2025, issued in counterpart CN Application No. 202180066285.7, with English translation. (32 pages).

* cited by examiner

FAN DRIP-PROOF STRUCTURE

TECHNICAL FIELD

An embodiment of the present invention relates to a fan drip-proof structure.

BACKGROUND

In the related art, an electric power control apparatus that includes a fan inside a housing which accommodates an electronic device is known. The fan cools the electronic device by air introduced to the inside from the outside through an intake port of the housing. The fan discharges the air that has cooled the electronic device to the outside from the inside through an exhaust port of the housing.

However, in a case where a vent port formed in the housing is exposed to the outside, when a foreign object such as a water droplet enters the inside of the housing through the vent port, there is a possibility that an abnormality such as a short circuit may occur at the electronic device inside the housing.

RELATED ART DOCUMENTS

Patent Documents

[Patent Document 1]
Japanese Unexamined Patent Application, First Publication No. 2020-44949
[Patent Document 2]
Japanese Unexamined Patent Application, First Publication No. 2020-150671

SUMMARY OF INVENTION

Problems to be Solved by the Invention

A problem to be solved by the present invention is to provide a fan drip-proof structure capable of preventing a foreign object from entering the inside of a housing of a fan.

Means for Solving the Problem

A fan drip-proof structure of an embodiment includes a housing, one or more open-close members, and a regulation member. The housing accommodates a fan. The one or more open-close members open and close a vent port formed on the housing in response to a wind force of an air flow of the fan. The regulation member regulates an open degree of the vent port by the open-close member.

DESCRIPTION OF THE EMBODIMENTS

Hereinafter, a fan drip-proof structure according to an embodiment will be described with reference to the drawings.

Figure 1:
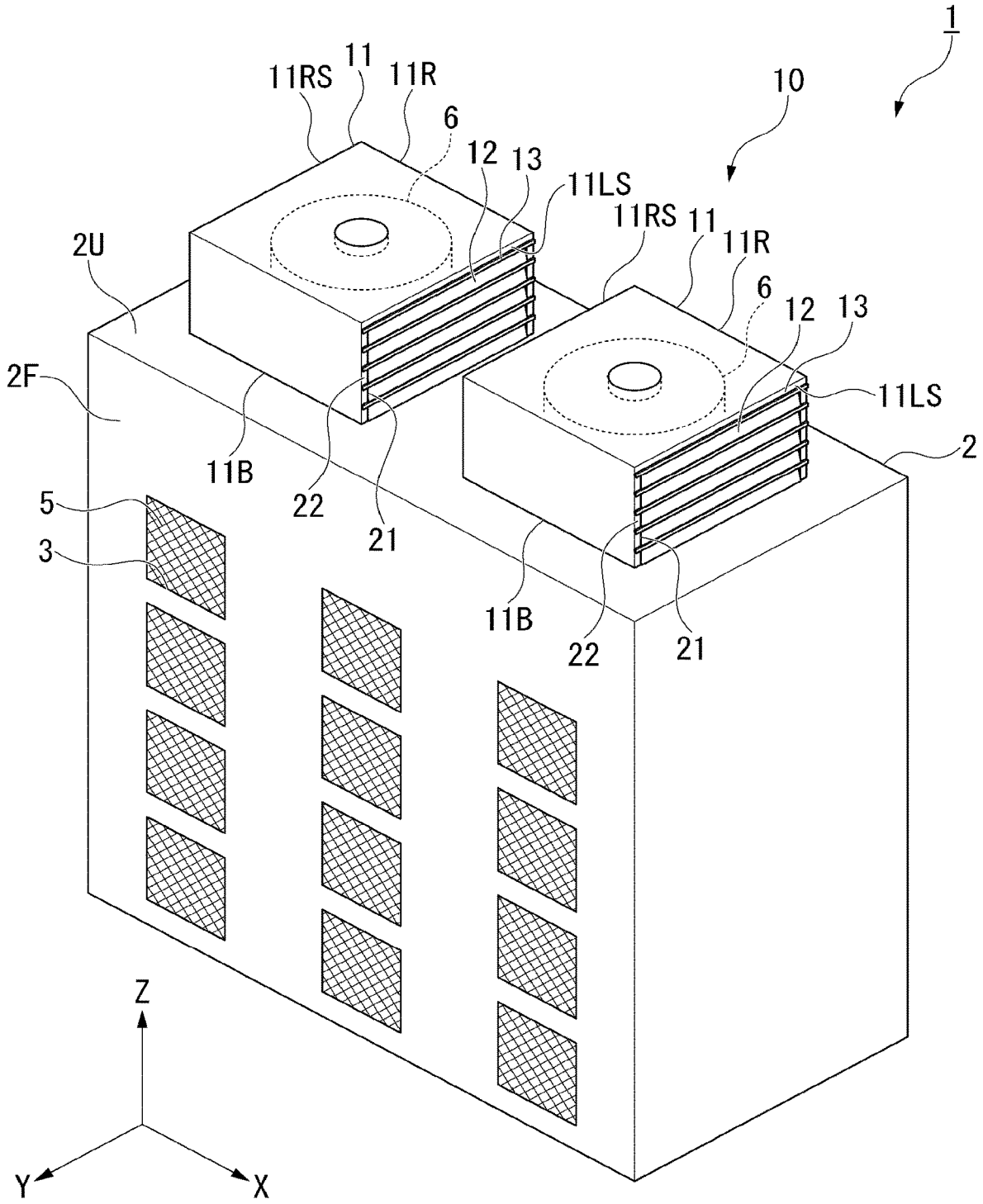
FIG. 1 is a perspective view showing a configuration of an electrical device unit that includes a fan drip-proof structure according to an embodiment.
Figure 2:
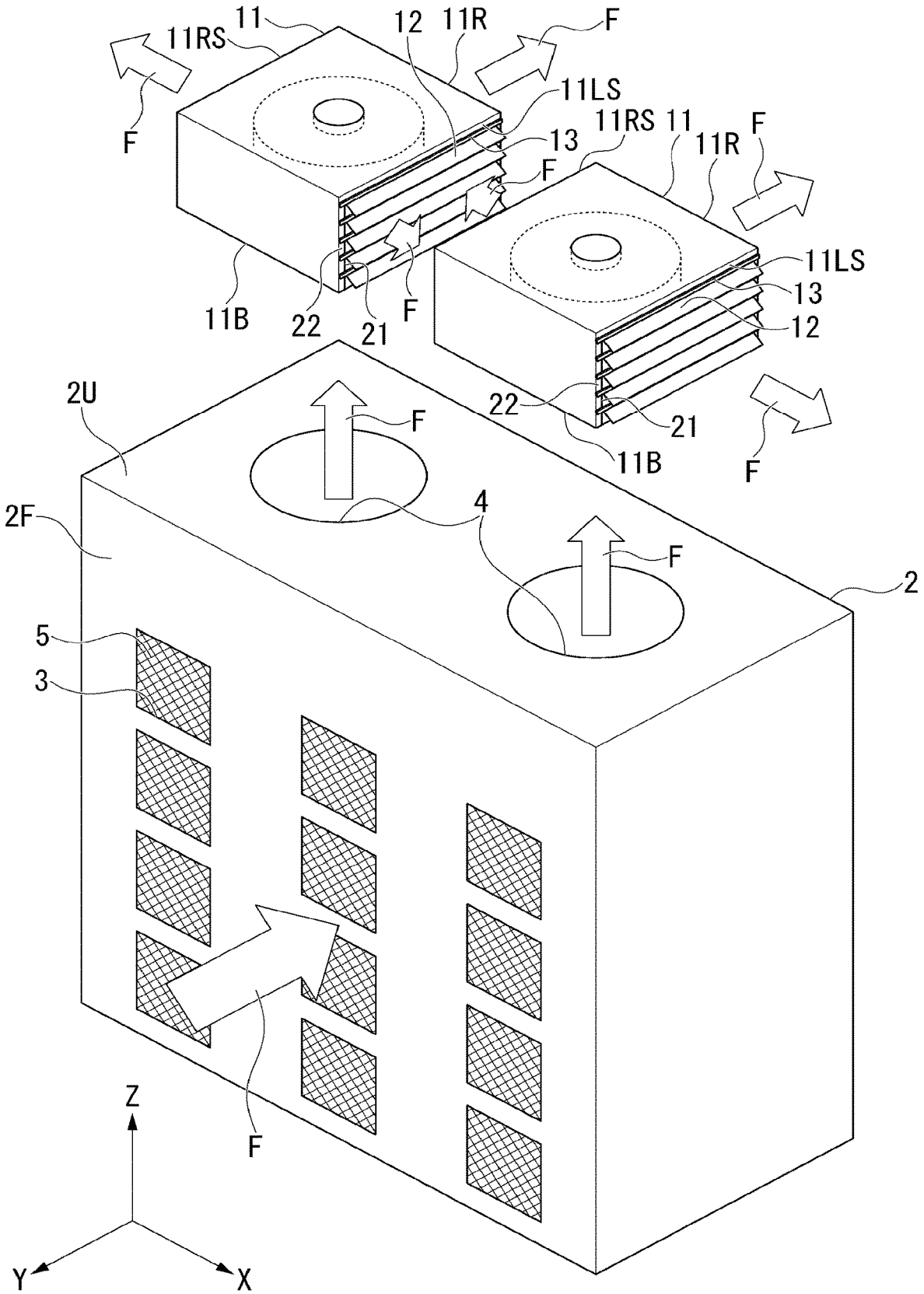
FIG. 2 is an exploded perspective view showing an example of a ventilation state in the electrical device unit that includes the fan drip-proof structure according to the embodiment.

FIG. 1 is a perspective view showing a configuration of an electrical device unit 1 that includes a fan drip-proof structure 10 according to the embodiment. FIG. 2 is an exploded perspective view showing an example of a ventilation state in the electrical device unit 1 that includes the fan drip-proof structure 10 according to the embodiment.

Hereinafter, each axis direction of the X-axis, the Y-axis, and the Z-axis orthogonal to one another in a three-dimensional space is in a direction parallel to each axis of the electrical device unit 1. For example, a rightward-leftward direction of the electrical device unit 1 is parallel to the X-axis direction. A forward-rearward direction of the electrical device unit 1 is parallel to the Y-axis direction. An upward-downward direction and a vertical direction of the electrical device unit 1 are parallel to the Z-axis direction. The positive direction of the Z-axis direction is a direction toward an upper part from a lower part of the electrical device unit 1.

As shown in FIG. 1 and FIG. 2, the electrical device unit 1 of the embodiment is, for example, a board provided to an electrical facility or the like. The board is a switchboard, a distribution board, a control board, and the like that constitute an electric power conversion apparatus, an electric power supply apparatus, a motor drive apparatus, or the like.

The electrical device unit 1 includes a unit housing 2 that accommodates a variety of electrical devices therein. The variety of electrical devices may be, for example, an electric power converter such as an inverter, a control device, or the like. The variety of electrical devices may include, for example, a variety of circuit components such as a semiconductor element, a conductor, a fuse, a capacitor, a transformer, a switch, a circuit breaker, and a measurement device.

The outer shape of the unit housing 2 may be, for example, a box shape. A plurality of intake ports 3 and a plurality of exhaust ports 4 by which the outside and the inside communicate with each other are formed in the unit housing 2. The plurality of intake ports 3 are formed, for example on a front part 2F of the unit housing 2. A plurality of exhaust ports 4 are formed, for example, on an upper part 2U of the unit housing 2. The plurality of intake ports 3 and the plurality of exhaust ports 4 ventilate cooling air that flows through the inside of the unit housing 2.

The unit housing 2 includes, for example, an air filter 5 that covers each of the plurality of intake ports 3. The outer shape of the air filter 5 is, for example, a mesh shape in which a plurality of through holes are formed. The air filter 5 separates and collects a foreign object such as dust from air that passes through the plurality of through holes and thereby flows to the inside of the unit housing 2 from the intake port 3.

The electrical device unit 1 includes a plurality of fans 6 that are arranged on the upper part 2U of the unit housing 2. The number of the plurality of fans 6 is the same as, for example, the number of the plurality of exhaust ports 4 formed in the unit housing 2. The fan 6 is, for example, a centrifugal fan. The fan 6 is arranged such that a suction port (not shown) of the fan 6 faces the exhaust port 4 of the unit housing 2 in the Z-axis direction.

The fan 6 suctions air outside the unit housing 2 to the inside from the plurality of intake ports 3 of the unit housing 2 and discharges the air inside the unit housing 2 to the outside from the plurality of exhaust ports 4 of the unit housing 2. The fan 6 cools various electrical devices by the air that flows through the inside of the unit housing 2.

The electrical device unit 1 includes the fan drip-proof structure 10 provided on each of the plurality of fans 6.

Figure 3:
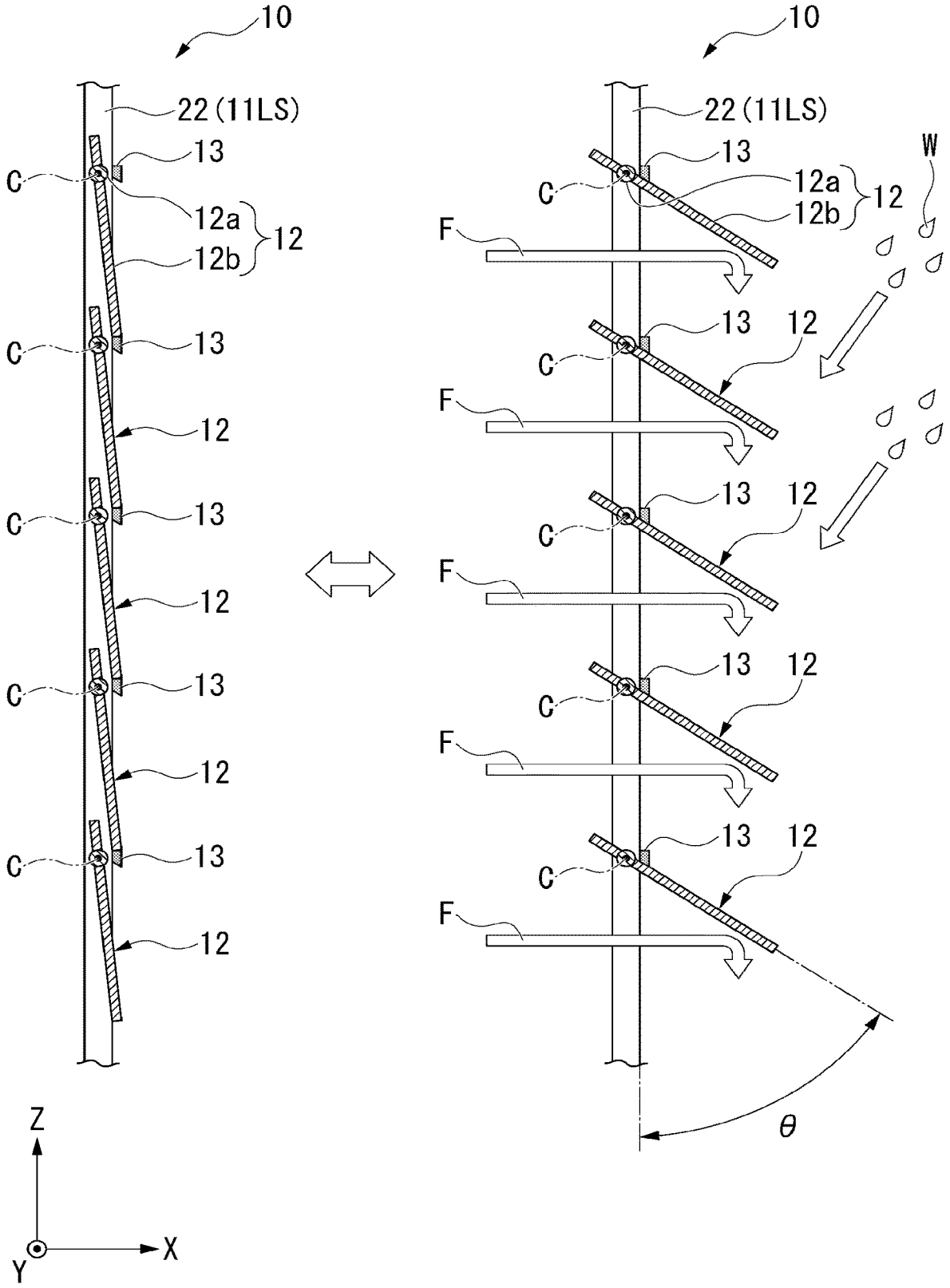
FIG. 3 is a cross-sectional view showing the fan drip-proof structure according to the embodiment broken at a cross-section parallel to the X-Z plane and is a view showing a transition between a closed state and an open state.

FIG. 3 is a cross-sectional view showing the fan drip-proof structure 10 according to the embodiment broken at a cross-section parallel to an X-Z plane and is a As shown in FIG. 3, the fan drip-proof structure 10 includes a fan housing 11, a plurality of open-close members 12, and a plurality of regulation members 13.

As shown in FIG. 1 and FIG. 2, the outer shape of the fan housing 11 is, for example, a box shape in which an opening is formed in a lower part 11B. The fan housing 11 is fixed to an upper part 2U of the unit housing 2. The lower part 11B of the fan housing 11 is in contact with the upper part 2U of the unit housing 2 at a circumferential edge of the exhaust port 4 so as to surround the exhaust port 4 of the unit housing 2. The fan housing 11 accommodates the fan 6 therein.

A plurality of blowing ports 21 by which the inside and the outside communicate with each other are formed on the fan housing 11. The plurality of blowing ports 21 are formed, for example, on each of both end parts (that is, right and left side parts) 11RS and 11LS in the rightward-leftward direction of the fan housing 11 and a rear part 11R. Each blowing port 21 is, for example, an opening having a rectangular shape elongated in the Y-direction. The plurality of blowing ports 21 discharge air that is introduced to the inside of the fan housing 11 to the outside from the inside of the unit housing 2 by the air flow of the fan 6.

As shown in FIG. 3, each of the plurality of open-close members 12 includes, for example, a shaft part 12*a* and a plate-shape part 12*b*.

The shaft part 12*a* is supported by a circumferential edge 22 of each blowing port 21 of the fan housing 11. The shaft part 12*a* rotates about a center axis line C as a rotation axis. The center axis line C of the shaft part 12*a* is parallel to a direction orthogonal to the upward-downward direction of the fan housing 11. For example, in a case of each open-close member 12 arranged on the blowing port 21 at each of the right and left end parts (that is, right and left side parts) 11RS and 11LS of the fan housing 11, the center axis line C of each shaft part 12*a* is parallel to the forward-rearward direction. For example, in a case of the open-close member 12 arranged on the blowing port 21 at the rear part 11R of the fan housing 11, the center axis line C of the shaft part 12*a* is parallel to the rightward-leftward direction.

The outer shape of the plate-shape part 12*b* is, for example, a rectangular plate shape elongated in the Y-direction so as to correspond to the shape of the blowing port 21. The plate-shape part 12*b* is integral with the shaft part 12*a*. For example, among a longer direction and a shorter direction that are orthogonal to the thickness direction of the plate-shape part 12*b*, the longer direction is parallel to the center axis line C of the shaft part 12*a*. One end in the shorter direction of the plate-shape part 12*b* is connected to a circumferential surface of the shaft part 12*a*. The plate-shape part 12*b* rotates together with the shaft part 12*a* around the center axis line C of the shaft part 12*a*.

The plurality of open-close members 12 are arranged side-by-side in the upward-downward direction. The plurality of open-close members 12 are parallel to each other in a direction (for example, the Y-direction) orthogonal to the upward-downward direction. The open-close member 12 becomes a closed state by its own weight. Any two adjacent open-close members 12 in the upward-downward direction are arranged, for example, so as to partially overlap each other in a closed state.

The plurality of open-close members 12 open and close the blowing port 21 in response to a wind force of the air flow of the fan 6. The plate-shape part 12*b* of each open-close member 12 receives the wind force of air F toward the outside from the inside via the blowing port 21 of the fan housing 11 by the air flow of the fan 6. Each plate-shape part 12*b* rotates about the center axis line C of the shaft part 12*a* to cause the blowing port 21 to be in an open state by receiving a wind force having a predetermined amplitude or more. The wind force, having a predetermined amplitude or more, rotates the plate-shape part 12*b* about the center axis line C against the weight of the plate-shape part 12*b*, the friction of the shaft part 12*a*, and the like.

Each plate-shape part 12*b* becomes an attitude that causes the blowing port 21 to be in a closed state by its own weight when receiving a wind force having an amplitude which is less than the predetermined amplitude.

The outer shape of each of the plurality of regulation members 13 is, for example, a rod shape that is elongated in the Y-direction. The number of the plurality of regulation members 13 is the same as the number of the plurality of open-close members 12. Each regulation member 13 is fixed, for example, to the circumferential edge 22 at a further outside of the blowing port 21 than each open-close member 12. Each regulation member 13 is parallel to the shaft part 12*a* of each open-close member 12.

Each regulation member 13 regulates the open degree of the blowing port 21 by each open-close member 12. For example, each regulation member 13 permits rotation around the center axis line C of the plate-shape part 12*b* without contacting the plate-shape part 12*b* when an inclination angle θ of the plate-shape part 12*b* of each open-close member 12 relative to a lower direction in the vertical direction is less than a predetermined angle. Each regulation member 13 prohibits an increase in the inclination angle θ by contacting the plate-shape part 12*b* when the inclination angle θ of the plate-shape part 12*b* is a predetermined angle.

Each regulation member 13 permits such rotation of the plate-shape part 12*b* that the inclination angle θ becomes smaller than the predetermined angle and prohibits such rotation of the plate-shape part 12*b* that the inclination angle θ becomes larger than the predetermined angle. The predetermined angle is an angle required for ensuring a desired drip-proof performance and is, for example, 60° or the like.

Hereinafter, an operation of the fan drip-proof structure 10 according to the embodiment is described.

As shown in FIG. 2, when each fan 6 operates, first, the cooling air F passes through the plurality of intake ports 3 and flows to the inside from the outside of the unit housing 2. Next, the air F flows through the inside of the unit housing 2, cools various electrical devices, and then flows to the outside from the plurality of exhaust ports 4.

Next, the air F passes through an opening (not shown) in the lower part 11B of the fan housing 11 and flows to the inside of the fan housing 11. Next, the air F passes through a suction port (not shown) of the fan 6, is suctioned to the inside of the fan 6, and is then discharged from a discharge port (not shown) to the outside.

Next, the air F flows toward each blowing port 21 of the fan housing 11 and applies a wind pressure to the plate-shape part 12*b* of each open-close member 12. The air F rotates the plate-shape part 12*b* of each open-close member 12 by a wind force having a predetermined amplitude or more and thereby causes each blowing port 21 to be in an open state. Next, the air F passes through each blowing port 21 and flows to the outside of the fan housing 11.

Figure 4:
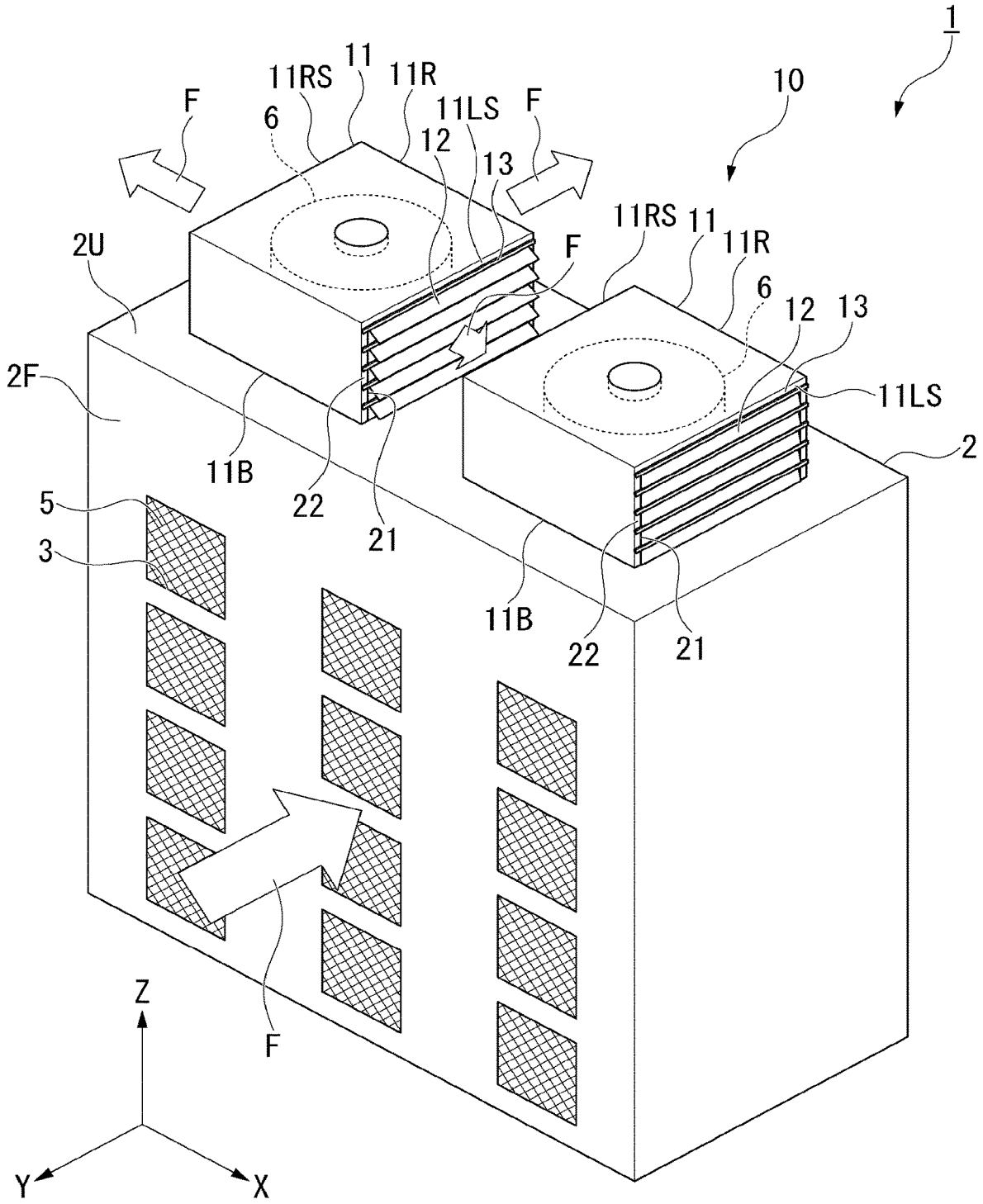
FIG. 4 is a perspective view showing an example of an operation in the fan drip-proof structure according to the embodiment.

FIG. 4 is a perspective view showing an example of the operation in the fan drip-proof structure 10 according to the embodiment. As shown in FIG. 4, when only a fan 6 which is part of the plurality of fans 6 operates, the plurality of open-close members 12 become an open state in the fan housing 11 of an operating fan 6, and the plurality of open-close members 12 are maintained to be in a closed state in the fan housing 11 of a stopping fan 6.

In the fan housing 11 of the stopping fan 6, since each blowing port 21 is closed, it is prohibited, for example, that air flows back to the inside from the outside through each blowing port 21. For example, it is prohibited to form such a circulating air flow that the air suctioned from the fan housing 11 of the stopping fan 6 is discharged from the fan housing 11 of the operating fan 6 through the unit housing 2.

Here, the open-close member 12 (the plate-shape part 12*b*) in the open state is regulated so as not to rotate larger than an angle required for ensuring the desired drip-proof performance by the regulation member 13. Therefore, even when the plurality of open-close members 12 are maintained in the open state, it is prevented that a foreign object such as a water droplet W enters the inside of the fan housing 11 through each blowing port 21.

According to the embodiment described above, the fan drip-proof structure 10 includes the open-close member 12 that opens and closes the blowing port 21 formed on the fan housing 11 in response to the wind force of the air flow of the fan 6 and can thereby prevent a foreign object such as the water droplet W from entering the inside of the fan housing 11. The fan drip-proof structure 10 includes the regulation member 13 that regulates the open degree of the blowing port 21 by the open-close member 12 and can thereby ensure desired drip-proof and dust-proof performances.

The fan drip-proof structure 10 includes the plurality of open-close members 12 that open and close the blowing port 21 by rotating by the wind force of the air flow of the fan 6 or its own weight, and thereby, it is possible to ensure the desired drip-proof and dust-proof performances while preventing the configuration from being complicated and preventing the configuration from being enlarged. For example, as compared to a case in which configurations such as a drip-proof cover and a shutter for preventing the backflow of the air are added to the fan housing 11, it is possible to prevent the increase and complication of the configuration.

By including a plurality of open-close members 12 which become a closed state during stopping of the fan 6, it is possible to prevent the occurrence of backflow of air between the fan housing 11 of the stopping fan 6 and the fan housing 11 of the operating fan 6.

Hereinafter, a modified example is described.

The above embodiment is described using an example in which the electrical device unit 1 includes the fan drip-proof structure 10 provided on each of the plurality of fans 6; however, the embodiment is not limited thereto. The electrical device unit 1 may include a single fan 6 and a fan drip-proof structure 10 provided on the single fan 6.

The above embodiment is described using an example in which the outer shape of the fan housing 11 is a box shape; however, the embodiment is not limited thereto. For example, the outer shape of the fan housing 11 may be any suitable shape such as a cylindrical shape.

The above embodiment is described using an example in which each of the plurality of open-close members 12 includes the shaft part 12*a* that is supported by the fan housing 11 and the plate-shape part 12*b* that is integral with the shaft part 12*a*; however, the embodiment is not limited thereto. For example, each open-close member 12 may include a shaft part 12*a* that is fixed to the fan housing 11 and a plate-shape part 12*b* that is supported by the shaft part 12*a*. The shaft part 12*a* in this case does not rotate, and only the plate-shape part 12*b* rotates about the center axis line C of the shaft part 12*a*.

The above embodiment is described using an example in which the plurality of regulation members 13 are provided on the fan housing 11; however, the embodiment is not limited thereto. For example, each regulation member 13 may be provided on each open-close member 12. In this case, for example, the regulation member of each open-close member 12 prohibits an increase in the inclination angle θ by contacting the circumferential edge 22 of the blowing port 21 in the open state of each open-close member 12.

The above embodiment is described using an example in which the outer shape of each regulation member 13 is a rod shape; however, the embodiment is not limited thereto. The outer shape of each regulation member 13 may be any suitable shape.

The above embodiment is described using an example in which each of the plurality of open-close members 12 opens and closes the blowing port 21 by the rotation about the center axis line C; however, the embodiment is not limited thereto. For example, the plate-shape part 12*b* of each open-close member 12 may be formed of an elastic material and may open and close the blowing port 21 by elastically deforming in response to the wind force of the air flow of the fan 6.

The above embodiment is described using an example in which the plurality of blowing ports 21 are formed on the fan housing 11; however, the embodiment is not limited thereto. Alternatively, a single blowing port 21 may be formed on the fan housing 11.

The above embodiment is described using an example in which the blowing port 21 is formed on each of the rear part 11R and both end parts 11RS and 11LS in the rightward-leftward direction of the fan housing 11; however, the embodiment is not limited thereto. The blowing port 21 may be formed on a suitable portion of the fan housing 11.

According to at least one embodiment described above, the fan drip-proof structure 10 includes the open-close member 12 that opens and closes the blowing port 21 formed on the fan housing 11 in response to the wind force of the air flow of the fan 6 and can thereby prevent a foreign object such as a water droplet W from entering the fan housing 11. The fan drip-proof structure 10 includes the regulation member 13 that regulates the open degree of the blowing port 21 by the open-close member 12 and can thereby ensure desired drip-proof and dust-proof performance.

The fan drip-proof structure 10 includes the plurality of open-close members 12 that open and close the blowing port 21 by rotating by the wind force of the air flow of the fan 6 or its own weight, and thereby, it is possible to ensure the desired drip-proof and dust-proof performance while preventing the configuration from being complicated and preventing the configuration from being enlarged. For example, as compared to a case in which configurations such as a drip-proof cover and a shutter for preventing the backflow of the air are added to the fan housing 11, it is possible to prevent the increase and complication of the configuration.

By including a plurality of open-close members 12 which become a closed state during stopping of the fan 6, it is possible to prevent the occurrence of backflow of air between the fan housing 11 of the stopping fan 6 and the fan housing 11 of the operating fan 6.

Although some embodiments of the present invention have been described, these embodiments are presented as examples and do not limit the scope of the invention. These embodiments can be implemented in various other forms, and a variety of omissions, substitutions, and modifications can be made without departing from the scope of the invention. These embodiments and variations thereof are included in the scope and gist of the invention and are also included in the scope of the invention described in the appended claims and equivalence thereof.

DESCRIPTION OF THE REFERENCE SYMBOLS

1 Electrical device unit
2 Unit housing
3 Intake port
4 Exhaust port
6 Fan
10 Fan drip-proof structure
11 Fan housing
12 Open-close member
12*a* Shaft part
12*b* Plate-shape part
13 Regulation member
21 Blowing port
22 Circumferential edge

The invention claimed is:

1. A fan drip-proof structure comprising:

a fan housing that accommodates an impeller which rotates about a first rotation axis line parallel to an upward-downward direction, wherein the fan housing includes a lower surface which is orthogonal to the first rotation axis line and on which a suction port is formed;

a plurality of side surfaces which are parallel to the first rotation axis line and on which a blowing port is formed;

at least one open-close member that opens and closes the blowing port in response to a wind force of an air flow of the fan; and a regulation member that regulates an open degree of the blowing port by the open-close member, wherein the open-close member opens and closes the blowing port by rotating about a second rotation axis line parallel to a direction that crosses the upward-downward direction of the fan housing corresponding to a vertical direction in response to the wind force, the regulation member is a rod body provided along the second rotation axis line, the open-close member in an open state is regulated by the regulation member such that the open-close member in the open state is in contact with the regulation member and does not rotate larger than a first angle required for ensuring a desired drip-proof performance, the regulation member permits rotation around the second rotation axis line of the open-close member without contacting the open-close member when an inclination angle of the open-close member relative to a downward direction in the upward-downward direction is less than the first angle ensuring the desired drip-proof performance, and the regulation member prohibits an increase of the inclination angle by contacting the open-close member when the inclination angle of the open-close member is the first angle ensuring the desired drip-proof performance.

2. The fan drip-proof structure according to claim 1, wherein the open-close member opens and closes the blowing port by elastically deforming in response to the wind force.

3. The fan drip-proof structure according to claim 1, wherein the first angle is 60°.

4. The fan drip-proof structure according to claim 1, wherein the regulation member is fixed to the fan housing at a further outside than a shaft part of the open-close member, the shaft part being supported by the fan housing.

5. The fan drip-proof structure according to claim 1, wherein the blowing port is formed on each of three side surfaces of the fan housing among the plurality of side surfaces.

* * * * *